US010368670B2

(12) United States Patent
Heitzenrater

(10) Patent No.: US 10,368,670 B2
(45) Date of Patent: Aug. 6, 2019

(54) ADJUSTABLE INDOOR/OUTDOOR BEVERAGE HOLDER

(71) Applicant: Daniel Scott Heitzenrater, Unionville, PA (US)

(72) Inventor: Daniel Scott Heitzenrater, Unionville, PA (US)

( * ) Notice: Subject to any disclaimer, the term of this patent is extended or adjusted under 35 U.S.C. 154(b) by 0 days.

(21) Appl. No.: 15/467,947

(22) Filed: Mar. 23, 2017

(65) Prior Publication Data

US 2018/0271309 A1 Sep. 27, 2018

(51) Int. Cl.
*A47G 23/02* (2006.01)
*A45F 3/44* (2006.01)

(52) U.S. Cl.
CPC ..... *A47G 23/0225* (2013.01); *A45F 3/44* (2013.01)

(58) Field of Classification Search
CPC ..... A47G 23/0225; A47G 23/0241; A47G 2023/0283; B65D 81/3876
USPC ..... 220/739–743; 215/386; 248/359
See application file for complete search history.

(56) References Cited

U.S. PATENT DOCUMENTS 2,673,053 A * 3/1954 Kilian ..... B65F 1/141 220/475
6,575,417 B1 * 6/2003 Krommenakker ..... A47G 23/0225 248/151
8,181,811 B1 * 5/2012 Blake ..... A45B 23/00 220/475
8,567,617 B1 * 10/2013 Tapager ..... A47B 73/00 211/60.1
8,851,095 B2 * 10/2014 LeAnna ..... A45B 3/00 135/120.1
8,887,914 B2 * 11/2014 Allegretti ..... B65D 19/06 206/386
9,357,829 B1 * 6/2016 Ikier ..... A45F 3/44
D770,238 S * 11/2016 Lundwall ..... D7/620
2001/0048060 A1 * 12/2001 Brumfield ..... A45B 1/00 248/533
2003/0079766 A1 * 5/2003 Arrowood ..... A45F 3/44 135/16
2003/0145554 A1 * 8/2003 Young ..... E04C 3/30 52/848

(Continued)

*Primary Examiner* — Kareen K Thomas
(74) *Attorney, Agent, or Firm* — Michael Walters; Penn State Law IP Clinic

(57) ABSTRACT

A multiple-piece adjustable beverage holder, capable of accommodating numerous types and quantities of beverages simultaneously with ground penetration capability or insertion into a pedestal. The purpose of this invention is to provide the user a stable hands-free, lightweight, portable, product that keeps their beverage closer to the user at various heights. The receptacles accept cans, bottles, cups, inter alia with or without insulating devices (coolies, cuzzies, coozies, etc.) of various sizes. It can be modified to meet height requirements and ground conditions. When ground hardness does not permit insertion, any shaft can be inserted into the Pedestal to provide one the desired height. Once inserted into the ground or the Pedestal the product is self-supporting. The preferred manufacturing process is 3D printing/additive manufacturing due the size, cost, ease of use, and the ability to integrate logos, names, or other customized information on the invention. The material should be composed of plastic, graphite, aluminum or similar material to achieve a semi-rigid invention.

9 Claims, 7 Drawing Sheets

(56) References Cited

U.S. PATENT DOCUMENTS

| | | | | |
|---|---|---|---|---|
| 2004/0011931 | A1* | 1/2004 | Restifo | A45F 3/44 248/146 |
| 2007/0252375 | A1* | 11/2007 | Roiser | A63C 11/221 280/816 |
| 2008/0061195 | A1* | 3/2008 | Carnevali | F16M 11/14 248/125.8 |
| 2008/0283716 | A1* | 11/2008 | Roche | A47G 23/0225 248/523 |
| 2009/0294622 | A1* | 12/2009 | Medders | A47B 81/04 248/523 |
| 2012/0104190 | A1* | 5/2012 | Parent | A47G 29/1216 248/121 |
| 2012/0187136 | A1* | 7/2012 | Smith | A45F 3/44 220/739 |
| 2012/0199705 | A1* | 8/2012 | Will | A45F 3/44 248/121 |
| 2014/0332644 | A1* | 11/2014 | Davis | A45F 3/44 248/146 |
| 2017/0321426 | A1* | 11/2017 | Greer | B63B 17/02 |

* cited by examiner

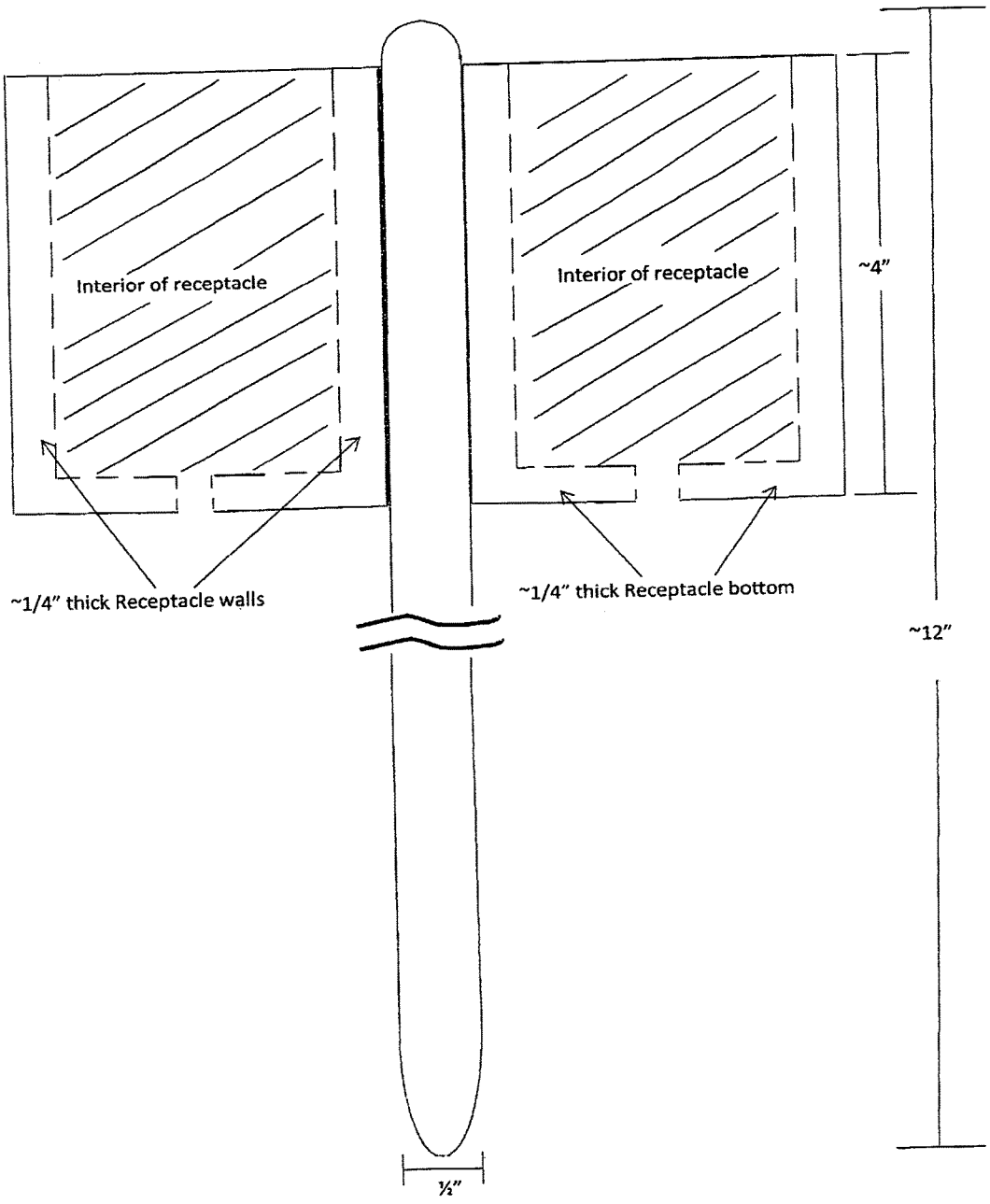
Figure 1; Upper Shaft
Side View

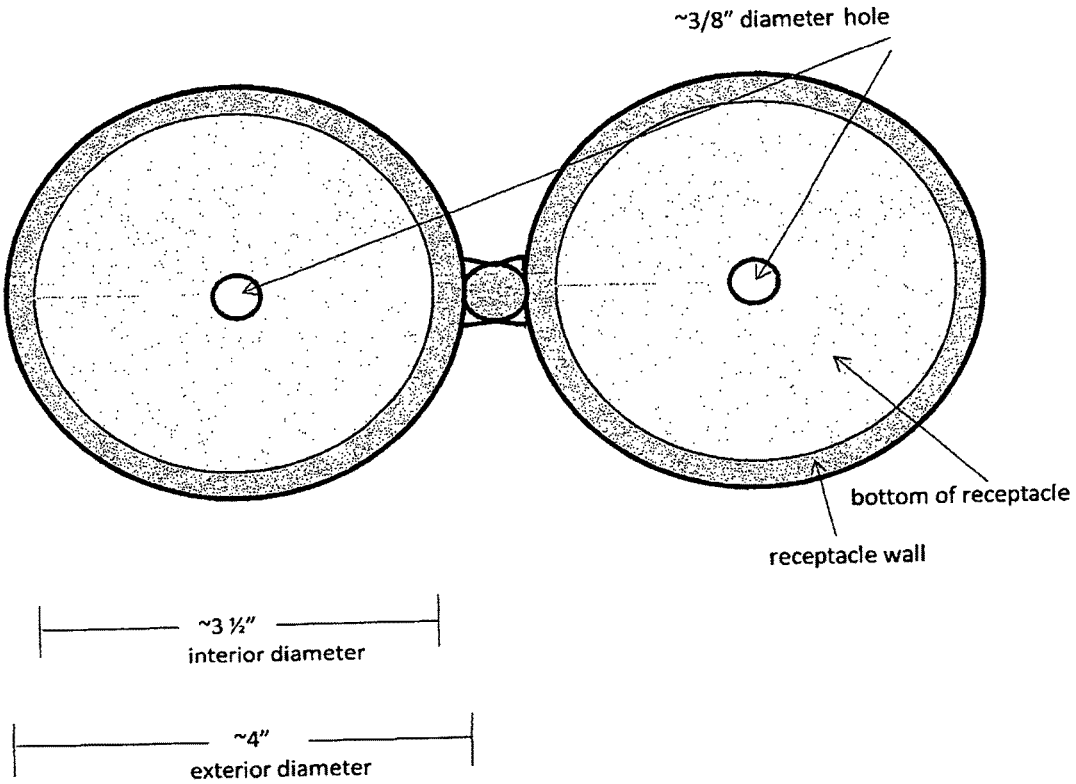
Figure 2: Upper Shaft
Top View

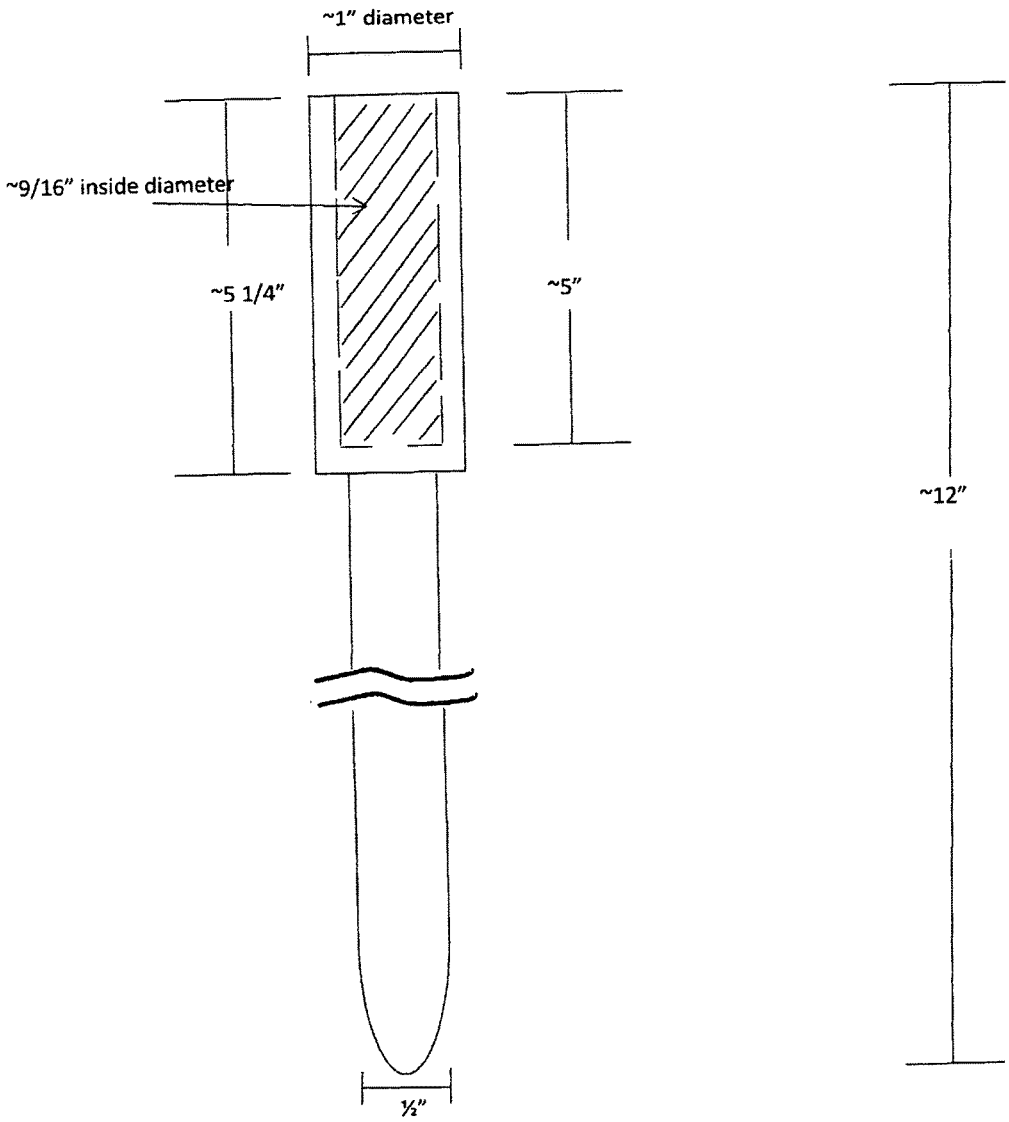
Figure 3; Lower Shaft
Side View

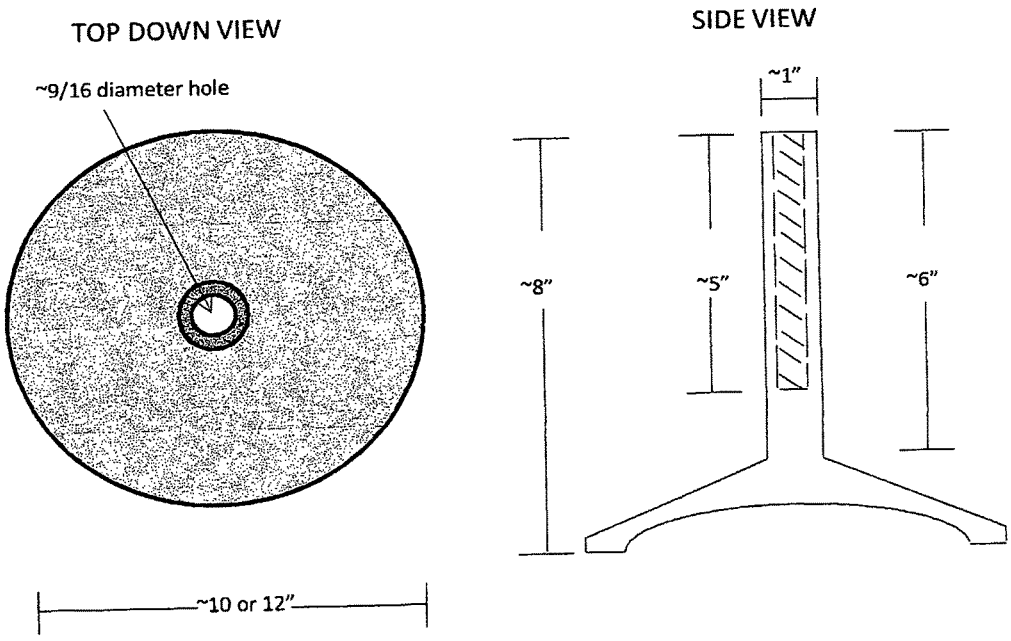
Figure 4; Pedestal

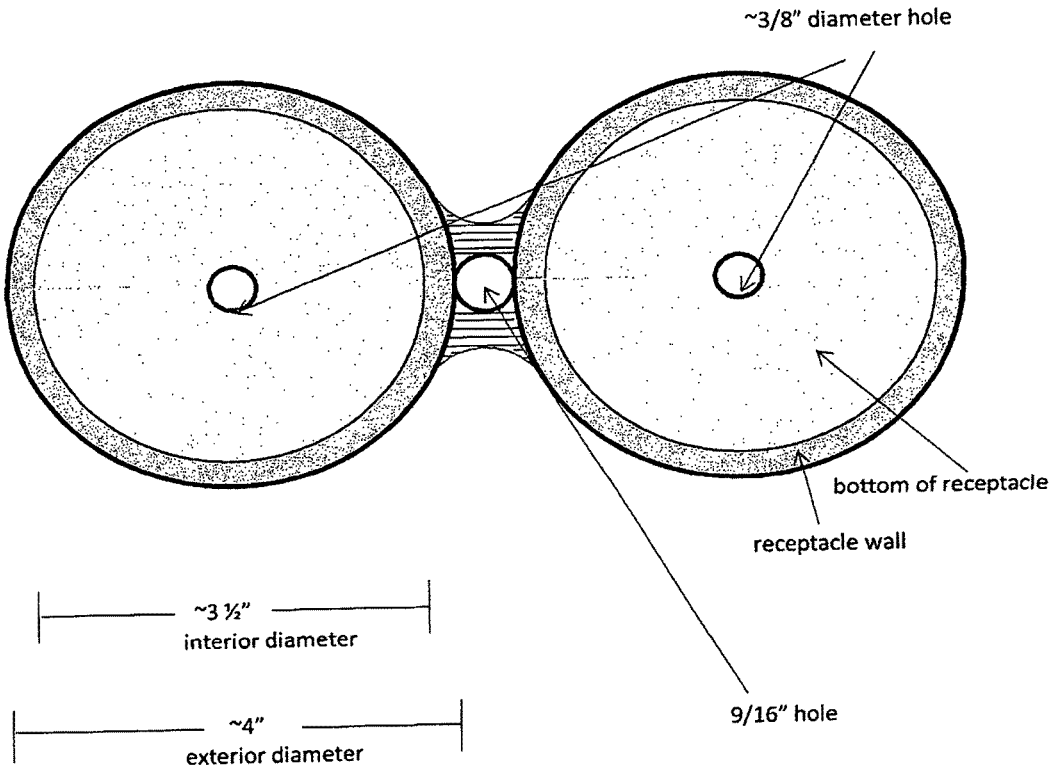
Figure 5; Optional Receptacles
Top View

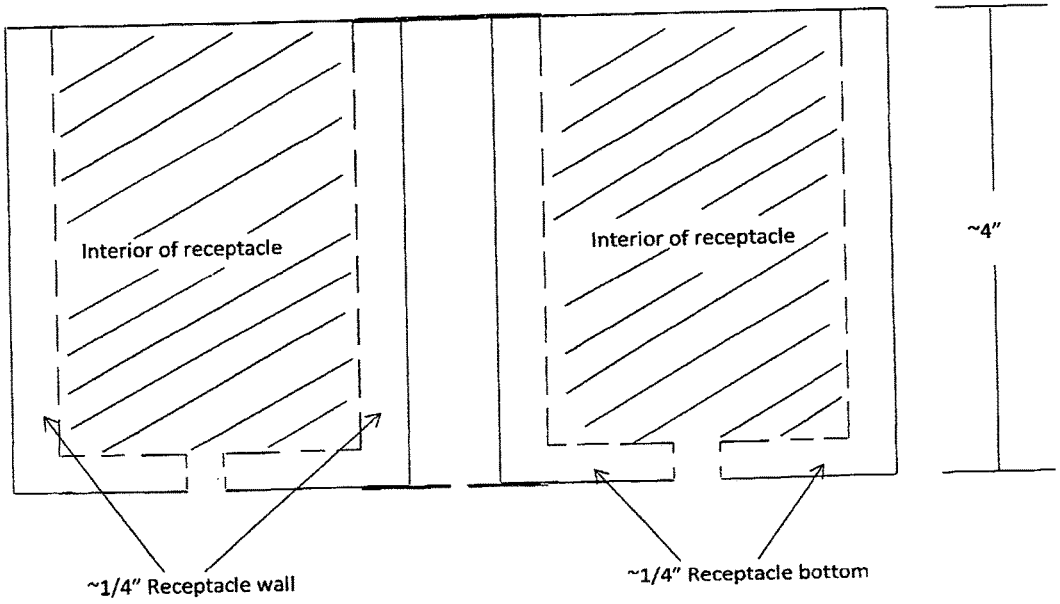
Figure 6; Optional Receptacles
SIDE VIEW

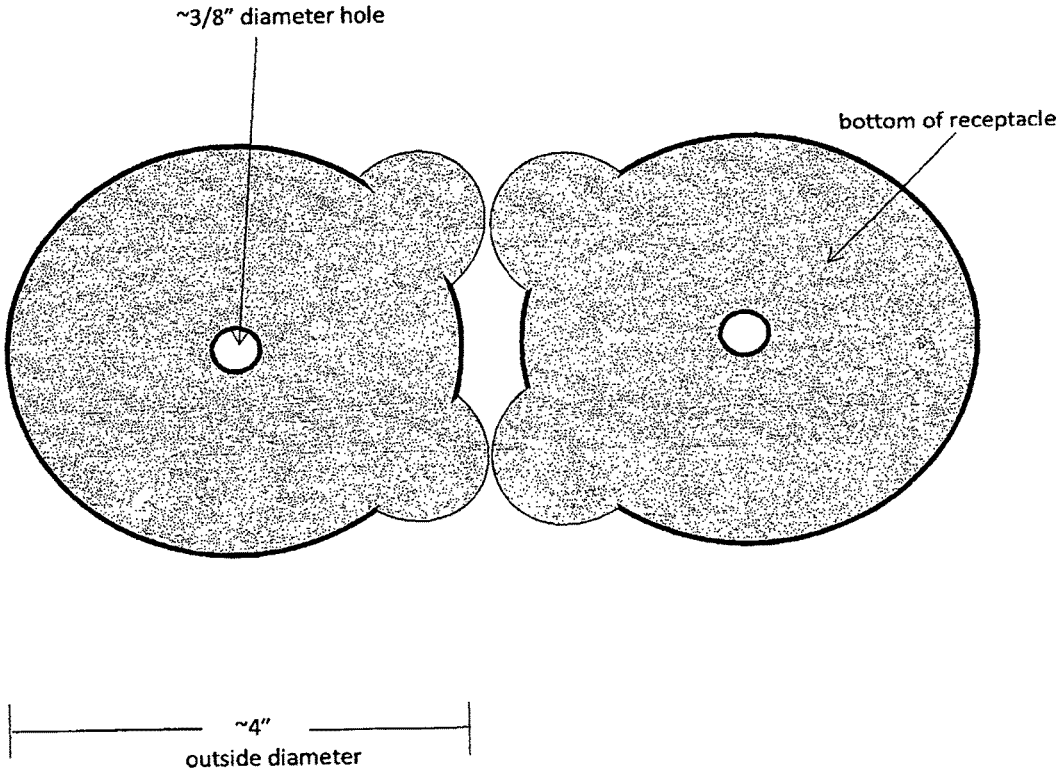
Figure 7; Optional Receptacles
Bottom Up View

ADJUSTABLE INDOOR/OUTDOOR BEVERAGE HOLDER

BACKGROUND OF THE INVENTION

This invention pertains to "beverage holder" field of endeavor A47G. Certain outdoor activities are enhanced with the ability to have easy access to one's beverage and also provide an occasional hands-free environment. Playing such outdoor games as horseshoes, corn hole, bocce ball, or sitting around a fire while consuming a beverage occasionally requires the beverage to be out of the user's hand. Currently most participants place their beverages on the ground. Placing a beverage on the ground invites dirt and insects and many times the ground is uneven and the beverage is susceptible to tip over so the user is forced to find even ground further away from their activity. In addition, the user must bend down to pick up their beverage when it is placed on the ground. This invention provides close, convenient, and stable access to their beverage.

Certain indoor leisure activities are enhanced with the ability to have elevated and easy access to one's beverage. Playing such indoor games as darts, pool, table tennis, even cards may not have an area that is close or convenient to place one's beverage. This invention provides close, convenient, and stable access to their beverage.

BRIEF SUMMARY OF THE INVENTION

A multiple-piece adjustable beverage holder, capable of accommodating numerous types and quantities of beverages simultaneously with ground penetration capability or insertion into a pedestal for outdoor or indoor use. The purpose of this invention is to provide the user a stable hands-free, lightweight, portable, product that keeps their beverage closer to the user at various heights.

BRIEF DESCRIPTION OF THE DRAWINGS

FIG. 1 depicts the Upper Shaft from the side view. Two receptacles are shown. Depending on material and manufacturing process, the receptacles can be attached to the shaft or made as one piece utilizing 3D printing (additive manufacturing) or other acceptable process. The total length of the shaft is approximately 12" long. The bottom of the shaft can be inserted into the top of the Lower Shaft. The bottom of the shaft has been tapered to allow for easier ground penetration.

FIG. 2 depicts the Upper Shaft from the top view. This view provides the approximate dimensions and orientation of the receptacles.

FIG. 3 depicts the Lower Shaft. This shaft is the same diameter of the Upper Shaft with an expanded female receiver for the Upper Shaft allowing the two to be used together. The bottom of the shaft has been tapered to allow for easier ground penetration.

FIG. 4 depicts the Pedestal. It is round with a concave bottom and the center of the plate rises up, approximately six inches, to accept the bottom of either the Upper or Lower Shaft. Therefore a hole with a diameter slightly larger than the shafts exists to accept either shaft.

FIG. 5 depicts the Optional Receptacles from the top view. The receptacles are identical to the Upper Shaft receptacles in shape and dimension. The top of the Optional Receptacles are attached by material, and have a hole that can be fitted over the top of the Upper Shaft. The bottom of the receptacles has tabs that fit underneath the Upper Shaft receptacles to hold it in place.

FIG. 6 depicts the Optional Receptacles from the side view. The receptacles are identical to the Upper Shaft receptacles in shape and dimension.

FIG. 7 depicts the Optional Receptacles from the bottom view. The bottom of the receptacles has tabs that fit underneath the Upper Shaft receptacles to hold it in place.

DETAILED DESCRIPTION OF THE DRAWINGS

A multiple-piece adjustable beverage holder, capable of accommodating numerous types and quantities of beverages simultaneously with ground penetration capability or insertion into a pedestal. The purpose of this invention is to provide the user a stable hands-free, lightweight, portable, product that keeps their beverage closer to the user at various heights. The receptacles accept cans, bottles, cups, inter alia with or without insulating devices (coolies, cuzzies, coozies, etc.) of various sizes. It can be modified to meet height requirements and ground conditions. When ground hardness does not permit insertion, any shaft can be inserted into the Pedestal to provide one the desired height. Once inserted into the ground or the Pedestal the product is self-supporting. The preferred manufacturing process is 3D printing/additive manufacturing due the size, cost, ease of use, and the ability to integrate logos, names, or other customized information on the invention. The material should be composed of plastic, graphite, aluminum or similar material to achieve a semi-rigid invention.

CROSS-REFERENCE TO RELATED APPLICATIONS

| References Cited | U.S. Patent Documents | |
|---|---|---|
| 4,334,661 | Jun. 15, 1982 | Pitt |
| 5,570,863 | Nov. 5, 1996 | Cooper |
| 5,823,496 | Oct. 20, 1998 | Foley |
| 6,575,417 | Jun. 10, 2003 | Krommenakker |
| 8,201,794 | Jun. 19, 2012 | Pesola |

There are several prior art patents regarding similar designs for beverage holders as noted below.

U.S. Pat. No. 4,334,661 depicts a one-piece stake that is driven into the ground for use.

U.S. Pat. No. 5,570,863 depicts a one-piece shaft that is driven into the ground for use.

U.S. Pat. No. 5,823,496 depicts a one piece surf fishing pole holder with an attached beverage holder that is driven into the ground for use.

U.S. Pat. No. 6,575,417 depicts a two piece system that has a shaft with a support member that is driven into the ground and beverage holder that is screwed onto the shaft.

U.S. Pat. No. 8,201,794 depicts a one piece system that can be driven into the ground or inserted into a flat base when applicable.

While the abovementioned art patents meet their prescribed purposes, the description below details how this presented invention provides new, novel, and non-obvious features.

U.S. Pat. Nos. 4,334,661, 5,570,863, 5,823,496, 6,575,417 can only be used where the ground is penetrable. It cannot be used on surfaces where the shaft is unable to penetrate such as, but not limited to, hard ground, a parking lot, driveway, patio, or a floor in a house. U.S. Pat. No.

8,201,794 has a base component that alleviates the problem of penetration but requires a smooth surface:

However, this multiple piece presented invention exceeds all the characteristics of the aforementioned patents.

Its simple design can be inserted in the ground or into a rounded pedestal. The round and concave pedestal reduces the aggravating effect uneven ground has on a square and or flat base component.

Some of the prior art requires parts to be screwed into each other while the presented invention does not.

None of the aforementioned patents are height adjustable. This presented invention has a Lower Shafts and a Upper Shaft allowing the user to adjust the height of the beverage receptacles. It can be used at multiple sitting heights and a standing height.

The Optional Receptacles allows the presented invention to double its holding capacity from two to four beverages. It can be easily added or removed according to preference. The novelty of this invention are described above and depicted in the Description of the Drawings attached herein.

I claim:

1. A height and quantity adjustable portable beverage holder adaptable to ground conditions comprising: a rod-shaped shaft, wherein said shaft comprises a male end and a female end, wherein:

a top portion of said shaft, referred to as an upper shaft, protrudes above a permanently affixed beverage receptacle wherein an additional beverage receptacle may be attached, wherein each beverage receptacle is configured in a manner suitable for holding a beverage in an upright position, and wherein said upper shaft can accept one or more additional beverage receptacles, and a lower portion of said shaft, referred to as a bottom end of said shaft, wherein said bottom end of said shaft is: angled to provide for easier entry into the ground or inserts into a pedestal comprising a concave bottom, wherein the additional beverage receptacles are constructed with a hole centered between the additional beverage receptacles to fasten around a top portion of the upper shaft and tabs at a bottom portion of said additional beverage receptacle wherein said tabs fit below hold said additional beverage receptacles in place on said upper shaft.

2. A height and quantity adjustable portable beverage holder as in claim 1, wherein the upper shaft comprises at least two cylindrical beverage receptacles permanently affixed to said upper shaft, wherein each of said cylindrical beverage receptacles comprise: (i) an inner diameter of at least three and one half inches, (ii) an one quarter inch thick wall, (iii) a height of four inches, and (iv) an opening in a bottom of each of said receptacle, wherein said opening is suitable to allow liquid out of said cylindrical beverage receptacle.

3. The height and quantity adjustable portable beverage holder adaptable to ground conditions of claim 1, wherein said pedestal is weighted and 10" to 12" in diameter.

4. A height adjustable beverage holder apparatus, comprising: a pedestal for positioning a height adjustable beverage holder apparatus; a rod-shaped shaft to affix a beverage receptacle wherein an upper shaft is connected to the lower shaft through male and female connectors wherein said beverage receptacle is suitable for accepting an individual beverage, wherein said beverage receptacle holds the individual beverage off a ground or a floor, and wherein said pedestal for positioning said height adjustable beverage holder apparatus comprises: (i) a weighted material for maintaining balance of said apparatus; (ii) a pedestal arch suitable for supporting and balancing said height adjustable beverage holder apparatus; (iii) a portal for balancing the shaft of said height adjustable beverage holder apparatus between said ground, or floor, and the pedestal.

5. The height adjustable beverage holder of claim 4, further comprising beverage holders wherein said beverage holders comprise a hole in a bottom, wherein said hole is suitable to allow for flow of air and/or liquid.

6. The height adjustable beverage holder of claim 4, wherein said shaft is comprised of: aluminum, plastic, steel carbon fiber, a rigid material, a semi-rigid material, and any combination thereof.

7. The height adjustable beverage holder of claim 4, wherein a female end is configured to accept the upper shaft.

8. The height adjustable beverage holder of claim 4, wherein a male end is angled to allow for easier insertion into the ground.

9. The height adjustable beverage holder of claim 4, wherein said beverage receptacle is shaped to accommodate a can, a bottle or a cup.

* * * * *